US011098951B2

(12) United States Patent
Kappus et al.

(10) Patent No.: US 11,098,951 B2
(45) Date of Patent: Aug. 24, 2021

(54) ULTRASONIC-ASSISTED LIQUID MANIPULATION

(71) Applicant: ULTRAHAPTICS IP LTD, Bristol (GB)

(72) Inventors: Brian Kappus, Mountain View, CA (US); Benjaimin John Oliver Long, Bristol (GB)

(73) Assignee: ULTRAHAPTICS IP LTD, Bristol (GB)

( * ) Notice: Subject to any disclaimer, the term of this patent is extended or adjusted under 35 U.S.C. 154(b) by 0 days.

(21) Appl. No.: 16/563,608

(22) Filed: Sep. 6, 2019

(65) Prior Publication Data

US 2020/0080776 A1 Mar. 12, 2020

Related U.S. Application Data

(60) Provisional application No. 62/728,829, filed on Sep. 9, 2018.

(51) Int. Cl.
*F26B 5/02* (2006.01)

(52) U.S. Cl.
CPC ..... *F26B 5/02* (2013.01)

(58) Field of Classification Search
CPC ..... F26B 5/02; F26B 5/00; F26B 5/06; F26B 9/00; F26B 3/00; F26B 3/283; F26B 7/00; F26B 21/004
USPC ..... 34/402
See application file for complete search history.

(56) References Cited

U.S. PATENT DOCUMENTS

| | | | |
|---|---|---|---|
| 4,218,921 A | 8/1980 | Berge | |
| 4,771,205 A | 9/1988 | Mequio | |
| 4,881,212 A | 11/1989 | Takeuchi | |
| 5,226,000 A | 7/1993 | Moses | |
| 5,329,682 A | 7/1994 | Thurn | |

(Continued)

FOREIGN PATENT DOCUMENTS

| | | | |
|---|---|---|---|
| CA | 2470115 A1 * | 6/2003 | ..... G01N 33/0049 |
| CN | 101986787 | 3/2011 | |

(Continued)

OTHER PUBLICATIONS

European Office Action for Application No. EP16750992.6, dated Oct. 2, 2019, 3 pages.

(Continued)

*Primary Examiner* — Stephen M Gravini
(74) *Attorney, Agent, or Firm* — Koffsky Schwalb LLC; Mark I. Koffsky

(57) ABSTRACT

A phased array of ultrasonic transducers may create arbitrary fields that can be utilized to manipulate fluids. This includes the translation of drops on smooth surfaces as well speeding the evaporation of fluids on wetted hands. Proposed herein is the use airborne ultrasound focused to the surface of the hand. The risk is that coupling directly into the bulk of the hand may cause damage to the cellular material through heating, mechanical stress, or cavitation. Using a phased array, the focus may be moved around, thus preventing acoustic energy from lingering too long on one particular position of the hand. While some signaling may penetrate into the hand, most of the energy (99.9%) is reflected. Also disclosed are methods to couple just to the wetted surface of the hand.

18 Claims, 8 Drawing Sheets

(56) References Cited

U.S. PATENT DOCUMENTS 5,426,388 A 6/1995 Flora
5,477,736 A * 12/1995 Lorraine ..... G10K 11/30 310/335
5,511,296 A 4/1996 Dias
6,029,518 A 2/2000 Oeftering
6,193,936 B1 * 2/2001 Gardner ..... B01J 4/00 422/186
6,503,204 B1 1/2003 Sumanaweera
6,647,359 B1 11/2003 Verplank
6,771,294 B1 8/2004 Pulli
6,772,490 B2 8/2004 Toda
6,800,987 B2 10/2004 Toda
7,109,789 B2 9/2006 Spencer
7,182,726 B2 * 2/2007 Williams ..... A61N 5/1001 600/3
7,225,404 B1 5/2007 Zilles
7,487,662 B2 * 2/2009 Schabron ..... G01N 27/626 422/83
7,577,260 B1 8/2009 Hooley
RE42,192 E * 3/2011 Schabron ..... G01N 27/70 436/124
8,000,481 B2 8/2011 Nishikawa
8,123,502 B2 2/2012 Blakey
8,269,168 B1 9/2012 Axelrod
8,279,193 B1 10/2012 Birnbaum
8,607,922 B1 12/2013 Werner
8,833,510 B2 9/2014 Koh
8,884,927 B1 11/2014 Cheatham, III
9,208,664 B1 12/2015 Peters
9,267,735 B2 * 2/2016 Funayama ..... F26B 7/00
9,421,291 B2 * 8/2016 Robert ..... F26B 21/003
9,612,658 B2 4/2017 Subramanian
9,662,680 B2 5/2017 Yamamoto
9,816,757 B1 * 11/2017 Zielinski ..... F26B 9/06
9,841,819 B2 12/2017 Carter
9,863,699 B2 * 1/2018 Corbin, III ..... A01N 1/0263
9,898,089 B2 * 2/2018 Subramanian ..... G06F 3/016
9,945,818 B2 4/2018 Ganti
9,977,120 B2 5/2018 Carter
10,101,811 B2 10/2018 Carter
10,101,814 B2 10/2018 Carter
10,133,353 B2 11/2018 Mohamad
10,140,776 B2 11/2018 Schwarz
10,146,353 B1 12/2018 Smith
10,469,973 B2 11/2019 Hayashi
10,569,300 B2 2/2020 Hoshi
2001/0033124 A1 10/2001 Norris
2002/0149570 A1 10/2002 Knowles
2003/0024317 A1 2/2003 Miller
2003/0144032 A1 7/2003 Brunner
2003/0182647 A1 9/2003 Radeskog
2004/0005715 A1 * 1/2004 Schabron ..... G01N 27/70 436/104
2004/0014434 A1 1/2004 Haardt
2004/0091119 A1 5/2004 Duraiswami
2004/0210158 A1 10/2004 Organ
2004/0226378 A1 11/2004 Oda
2004/0264707 A1 12/2004 Yang
2005/0052714 A1 3/2005 Klug
2005/0212760 A1 9/2005 Marvit
2006/0085049 A1 4/2006 Cory
2006/0090955 A1 5/2006 Cardas
2006/0091301 A1 5/2006 Trisnadi
2007/0036492 A1 2/2007 Lee
2007/0177681 A1 8/2007 Choi
2007/0263741 A1 11/2007 Erving
2008/0012647 A1 1/2008 Risbo
2008/0084789 A1 4/2008 Altman
2008/0130906 A1 6/2008 Goldstein
2008/0273723 A1 11/2008 Hartung
2008/0300055 A1 12/2008 Lutnick
2009/0093724 A1 4/2009 Pernot
2009/0116660 A1 5/2009 Croft, III
2009/0232684 A1 9/2009 Hirata
2009/0251421 A1 10/2009 Bloebaum
2009/0319065 A1 12/2009 Risbo
2010/0013613 A1 1/2010 Weston
2010/0030076 A1 2/2010 Vortman
2010/0044120 A1 2/2010 Richter
2010/0085168 A1 4/2010 Kyung
2010/0103246 A1 4/2010 Schwerdtner
2010/0109481 A1 5/2010 Buccafusca
2010/0199232 A1 8/2010 Mistry
2010/0231508 A1 9/2010 Cruz-Hernandez
2010/0262008 A1 10/2010 Roundhill
2010/0321216 A1 12/2010 Jonsson
2011/0006888 A1 1/2011 Bae
2011/0010958 A1 * 1/2011 Clark ..... A45D 20/10 34/97
2011/0051554 A1 3/2011 Varray
2011/0066032 A1 3/2011 Vitek
2011/0199342 A1 8/2011 Vartanian
2011/0310028 A1 12/2011 Camp, Jr.
2012/0057733 A1 3/2012 Morii
2012/0063628 A1 3/2012 Rizzello
2012/0066280 A1 3/2012 Tsutsui
2012/0223880 A1 9/2012 Birnbaum
2012/0229400 A1 9/2012 Birnbaum
2012/0229401 A1 9/2012 Birnbaum
2012/0236689 A1 9/2012 Brown
2012/0249409 A1 10/2012 Toney
2012/0249474 A1 10/2012 Pratt
2012/0299853 A1 11/2012 Dagar
2012/0307649 A1 12/2012 Park
2012/0315605 A1 12/2012 Cho
2013/0035582 A1 2/2013 Radulescu
2013/0094678 A1 4/2013 Scholte
2013/0100008 A1 4/2013 Marti
2013/0101141 A1 4/2013 McElveen
2013/0173658 A1 7/2013 Adelman
2014/0027201 A1 1/2014 Islam
2014/0104274 A1 4/2014 Hilliges
2014/0139071 A1 5/2014 Yamamoto
2014/0168091 A1 6/2014 Jones
2014/0204002 A1 7/2014 Bennet
2014/0265572 A1 9/2014 Siedenburg
2015/0002477 A1 1/2015 Cheatham, III
2015/0005039 A1 1/2015 Min
2015/0006645 A1 1/2015 Oh
2015/0007025 A1 1/2015 Sassi
2015/0013023 A1 1/2015 Wang
2015/0066445 A1 3/2015 Lin
2015/0070147 A1 3/2015 Cruz-Hernandez
2015/0070245 A1 3/2015 Han
2015/0078136 A1 3/2015 Sun
2015/0081110 A1 3/2015 Houston
2015/0110310 A1 4/2015 Minnaar
2015/0130323 A1 5/2015 Harris
2015/0168205 A1 6/2015 Lee
2015/0192995 A1 7/2015 Subramanian
2015/0220199 A1 8/2015 Wang
2015/0226537 A1 8/2015 Schorre
2015/0226831 A1 8/2015 Nakamura
2015/0248787 A1 9/2015 Abovitz
2015/0258431 A1 9/2015 Stafford
2015/0277610 A1 10/2015 Kim
2015/0304789 A1 10/2015 Babayoff
2015/0331576 A1 11/2015 Piya
2015/0332075 A1 11/2015 Burch
2016/0019762 A1 1/2016 Levesque
2016/0019879 A1 1/2016 Daley
2016/0026253 A1 1/2016 Bradski
2016/0044417 A1 2/2016 Clemen, Jr.
2016/0124080 A1 5/2016 Carter
2016/0138986 A1 5/2016 Carlin
2016/0175701 A1 6/2016 Froy
2016/0175709 A1 6/2016 Idris
2016/0189702 A1 6/2016 Blanc
2016/0242724 A1 8/2016 Lavallee
2016/0246374 A1 8/2016 Carter
2016/0249150 A1 8/2016 Carter
2016/0291716 A1 10/2016 Boser
2016/0306423 A1 10/2016 Uttermann

(56) References Cited

U.S. PATENT DOCUMENTS

| | | | | |
|---|---|---|---|---|
| 2016/0320843 | A1 | 11/2016 | Long | |
| 2016/0339132 | A1* | 11/2016 | Cosman | F26B 3/04 |
| 2017/0002839 | A1 | 1/2017 | Bukland | |
| 2017/0004819 | A1 | 1/2017 | Ochiai | |
| 2017/0018171 | A1 | 1/2017 | Carter | |
| 2017/0052148 | A1 | 2/2017 | Estevez | |
| 2017/0123487 | A1 | 5/2017 | Hazra | |
| 2017/0123499 | A1 | 5/2017 | Eid | |
| 2017/0140552 | A1 | 5/2017 | Woo | |
| 2017/0144190 | A1 | 5/2017 | Hoshi | |
| 2017/0181725 | A1 | 6/2017 | Han | |
| 2017/0193768 | A1 | 7/2017 | Long | |
| 2017/0193823 | A1 | 7/2017 | Jiang | |
| 2017/0211022 | A1 | 7/2017 | Reinke | |
| 2018/0039333 | A1 | 2/2018 | Carter | |
| 2018/0074580 | A1 | 3/2018 | Hardee | |
| 2018/0081439 | A1 | 3/2018 | Daniels | |
| 2018/0139557 | A1 | 5/2018 | Ochiai | |
| 2018/0151035 | A1 | 5/2018 | Maalouf | |
| 2018/0166063 | A1 | 6/2018 | Long | |
| 2018/0304310 | A1 | 10/2018 | Long | |
| 2018/0350339 | A1 | 12/2018 | Macours | |
| 2018/0361174 | A1 | 12/2018 | Radulescu | |
| 2019/0038496 | A1 | 2/2019 | Levesque | |
| 2019/0091565 | A1 | 3/2019 | Nelson | |
| 2019/0175077 | A1 | 6/2019 | Zhang | |
| 2019/0196578 | A1 | 6/2019 | Iodice | |
| 2019/0197840 | A1 | 6/2019 | Kappus | |
| 2019/0197842 | A1 | 6/2019 | Long | |
| 2019/0235628 | A1 | 8/2019 | Lacroix | |
| 2020/0080776 | A1* | 3/2020 | Kappus | G10K 11/34 |

FOREIGN PATENT DOCUMENTS

| | | | | |
|---|---|---|---|---|
| CN | 102459900 | | 5/2012 | |
| CN | 102591512 | | 7/2012 | |
| CN | 103797379 | | 5/2014 | |
| CN | 103984414 | A | 8/2014 | |
| CN | 107340871 | A | 11/2017 | |
| EP | 309003 | | 3/1989 | |
| EP | 1875081 | A1 | 1/2008 | |
| EP | 1911530 | | 4/2008 | |
| EP | 2271129 | A1 | 1/2011 | |
| EP | 1461598 | B1 * | 4/2014 | G01N 33/0049 |
| EP | 3207817 | A1 | 8/2017 | |
| GB | 2464117 | | 4/2010 | |
| GB | 2513884 | | 11/2014 | |
| GB | 2513884 | A | 11/2014 | |
| GB | 2530036 | | 3/2016 | |
| JP | 2008074075 | | 4/2008 | |
| JP | 2010109579 | | 5/2010 | |
| JP | 2011172074 | | 9/2011 | |
| JP | 2012048378 | | 3/2012 | |
| JP | 2016035646 | | 3/2016 | |
| KR | 20120065779 | | 6/2012 | |
| KR | 20130055972 | | 5/2013 | |
| KR | 20160008280 | | 1/2016 | |
| WO | 9118486 | | 11/1991 | |
| WO | 9639754 | | 12/1996 | |
| WO | WO-03050511 | A1 * | 6/2003 | G01N 27/626 |
| WO | 2005017965 | | 2/2005 | |
| WO | WO-2007144801 | A2 * | 12/2007 | A61M 37/0092 |
| WO | 2009071746 | A1 | 6/2009 | |
| WO | 2009112866 | | 9/2009 | |
| WO | 2010003836 | | 1/2010 | |
| WO | 2010139916 | | 12/2010 | |
| WO | 2011132012 | A1 | 10/2011 | |
| WO | 2012023864 | | 2/2012 | |
| WO | 2012104648 | A1 | 8/2012 | |
| WO | 2013179179 | | 12/2013 | |
| WO | 2014181084 | | 11/2014 | |
| WO | 2014181084 | A1 | 11/2014 | |
| WO | 2015006467 | | 1/2015 | |
| WO | 2015039622 | | 3/2015 | |
| WO | 2015127335 | | 8/2015 | |
| WO | 2016007920 | | 1/2016 | |
| WO | 2016095033 | A1 | 6/2016 | |
| WO | 2016132144 | | 8/2016 | |
| WO | 2016137675 | | 9/2016 | |
| WO | 2016162058 | | 10/2016 | |
| WO | 2017172006 | | 10/2017 | |
| WO | WO-2020049321 | A2 * | 3/2020 | F26B 3/04 |

OTHER PUBLICATIONS

Office Action dated Dec. 11, 2019 for U.S. Appl. No. 15/959,266 (pp. 1-15).

Jager et al., "Air-Coupled 40-KHZ Ultrasonic 2D-Phased Array Based on a 3D-Printed Waveguide Structure", 2017 IEEE, 4 pages.

Wooh et al., "Optimum beam steering of linear phased arays," Wave Motion 29 (1999) pp. 245-265, 21 pages.

Canada Application 2,909,804 Office Action dated Oct. 18, 2019, 4 pages.

Notice of Allowance dated Feb. 10, 2020, for U.S. Appl. No. 16/160,862 (pp. 1-9).

Office Action dated Mar. 20, 2020 for U.S. Appl. No. 15/210,661 (pp. 1-10).

Office Action dated Feb. 25, 2020 for U.S. Appl. No. 15/960,113 (pp. 1-7).

Office Action dated Feb. 7, 2020 for U.S. Appl. No. 16/159,695 (pp. 1-8).

Office Action dated Jan. 29, 2020 for U.S. Appl. No. 16/198,959 (p. 1-6).

Office Action dated Jan. 10, 2020 for U.S. Appl. No. 16/228,767 (pp. 1-6).

Yaroslav Ganin et al., Domain-Adversarial Training of Neural Networks, Journal of Machine Learning Research 17 (2016) 1-35, submitted May 15; published Apr. 16.

Yaroslav Ganin et al., Unsupervised Domain Adaptataion by Backpropagation, Skolkovo Institute of Science and Technology (Skoltech), Moscow Region, Russia, Proceedings of the 32nd International Conference on Machine Learning, Lille, France, 2015, JMLR: W&CP vol. 37, copyright 2015 by the author(s), 11 pages.

Ashish Shrivastava et al., Learning from Simulated and Unsupervised Images through Adversarial Training, Jul. 19, 2017, pp. 1-16.

Konstantinos Bousmalis et al., Domain Separation Networks, 29th Conference on Neural Information Processing Sysgtems (NIPS 2016), Barcelona, Spain. Aug. 22, 2016, pp. 1-15.

Eric Tzeng et al., Adversarial Discriminative Domain Adaptation, Feb. 17, 2017, pp. 1-10.

David Joseph Tan et al., Fits like a Glove: Rapid and Reliable Hand Shape Personalization, 2016 IEEE Conference on Computer Vision and Pattern Recognition, pp. 5610-5619.

Jonathan Taylor et al., Efficient and Precise Interactive Hand Tracking Through Joint, Continuous Optimization of Pose and Correspondences, SIGGRAPH '16 Technical Paper, Jul. 24-28, 2016, Anaheim, CA, ISBN: 978-1-4503-4279-87/16/07, pp. 1-12.

Toby Sharp et al., Accurate, Robust, and Flexible Real-time Hand Tracking, CHI '15, Apr. 18-23, 2015, Seoul, Republic of Korea, ACM 978-1-4503-3145-6/15/04, pp. 1-10.

Jonathan Taylor et al., Articulated Distance Fields for Ultra-Fast Tracking of Hands Interacting, ACM Transactions on Graphics, vol. 36, No. 4, Article 244, Publication Date: Nov. 2017, pp. 1-12.

GitHub—IntelRealSense/hand_tracking_samples: researc codebase for depth-based hand pose estimation using dynamics based tracking and CNNs, Mar. 26, 2020, 3 pages.

Stan Melax et al., Dynamics Based 3D Skeletal Hand Tracking, May 22, 2017, pp. 1-8.

Yarin Gal et al., Dropout as a Bayesian Approximation: Representing Model Uncertainty in Deep Learning, Oct. 4, 2016, pp. 1-12, Proceedings of the 33rd International Conference on Machine Learning, New York, NY, USA, 2016, JMLR: W&CP vol. 48.

Kaiming He et al., Deep Residual Learning for Image Recognition, http://image-net.org/challenges/LSVRC/2015/ and http://mscoco.org/dataset/#detections-challenge2015, Dec. 10, 2015, pp. 1-12.

Sergey Ioffe et al., Batch Normalization: Accelerating Deep Network Training by Reducing Internal Covariat Shift, Mar. 2, 2015, pp. 1-11.

(56) References Cited

OTHER PUBLICATIONS

Diederik P. Kingma et al., Adam: A Method for Stochastic Optimization, Jan. 30, 2017, pp. 1-15.
Christoper M. Bishop, Pattern Recognition and Machine Learning, pp. 1-758.
Markus Oberweger et al., DeepPrior++: Improving Fast and Accurate 3D Hand Pose Estimation, Aug. 28, 2017, pp. 1-10.
Markus Oberweger et al., Hands Deep in Deep Learning for Hand Pose Estimation, Dec. 2, 2016, pp. 1-10.
Mahdi Rad et al., Feature Mapping for Learning Fast and Accurate 3D Pose Inference from Synthetic Images, Mar. 26, 2018, pp. 1-14.
Jonathan Tompson et al., Real-Time Continuous Pose Recovery of Human Hands Using Convolutional Networks, ACM Trans. Graph. 33, 5, Article 169, pp. 1-10.
Vincent Lepetit et al., Model Based Augmentation and Testing of an Annotated Hand Pose Dataset, ResearchGate, https://www.researchgate.net/publication/307910344, Sep. 2016, 13 pages.
Shome Subhra Das, Detectioin of Self Intersection in Synthetic Hand Pose Generators, 2017 Fifteenth IAPR International Conference on Machine Vision Applications (MVA), Nagoya University, Nagoya, Japan, May 8-12, 2017, pp. 354-357.
Marin, About LibHand, LibHand—A Hand Articulation Library, www.libhand.org/index.html, Mar. 26, 2020, pp. 1-2; www.libhand.org/download.html, 1 page; www.libhand.org/examples.html, pp. 1-2.
GitHub—danfis/libccd: Library for collision detection between two convex shapes, Mar. 26, 2020, pp. 1-6.
OGRECave/ogre—GitHub: ogre/Samples/Media/materials at 7de80a7483f20b50f2b10d7ac6de9d9c6c87d364, Mar. 26, 2020, 1 page.
Shanxin Yuan et al., BigHand2.2M Bechmark: Hand Pose Dataset and State of the Art Analysis, Dec. 9, 2017, pp. 1-9.
Office Action dated Apr. 8, 2020, for U.S. Appl. No. 16/198,959 (pp. 1-17).
Office Action dated Apr. 16, 2020 for U.S. Appl. No. 15/839,184 (pp. 1-8).
Notice of Allowance dated Apr. 22, 2020 for U.S. Appl. No. 15/671,107 (pp. 1-5).
Office Action dated Apr. 17, 2020 for U.S. Appl. No. 16/401,148 (pp. 1-15).
Office Action dated Apr. 28, 2020 for U.S. Appl. No. 15/396,851 (pp. 1-12).
Office Action dated Apr. 29, 2020 for U.S. Appl. No. 16/374301 (pp. 1-18).
Nina Gaissert, Christian Wallraven, and Heinrich H. Bulthoff, "Visual and Haptic Perceptual Spaces Show High Similarity in Humans ", published to Journal of Vision in 2010, available at http://www.journalofvision.org/content/10/11/2 and retrieved on Apr. 22, 2020 ( Year: 2010), 20 pages.
Hua J, Qin H., Haptics-based dynamic implicit solid modeling, IEEE Trans Vis Comput Graph. Sep.-Oct. 2004;10(5):574-86.
Hilleges et al. Interactions in the air: adding further depth to interactive tabletops, UIST '09: Proceedings of the 22nd annual ACM symposium on User interface software and technologyOct. 2009 pp. 139-148.
International Search Report and Written Opinion for Application No. PCT/GB2019/051223, dated Aug. 8, 2019, 15 pages.
Partial International Search Report for Application No. PCT/GB2018/053735, dated Apr. 12, 2019, 14 pages.
International Search Report and Written Opinion for Application No. PCT/GB2018/053738, dated Apr. 11, 2019, 14 pages.
Sean Gustafson et al., "Imaginary Phone", Proceedings of the 24th Annual ACM Symposium on User Interface Software and Techology: Oct. 16-19, 2011, Santa Barbara, CA, USA, ACM, New York, NY, Oct. 16, 2011, pp. 283-292, XP058006125, DOI: 10.1145/2047196.2047233, ISBN: 978-1-4503-0716-1.
Office Action dated May 18, 2020 for U.S. Appl. No. 15/960,113 (pp. 1-21).
Optimal regularisation for acoustic source reconstruction by inverse methods, Y. Kim, P.A. Nelson, Institute of Sound and Vibration Research, University of Southampton, Southampton, SO17 1BJ, UK; 25 pages.
Takahashi et al., "Noncontact Tactile Display Based on Radiation Pressure of Airborne Ultrasound" IEEE Transactions on Haptics vol. 3, No. 3 p. 165 (2010).
International Search Report and Written Opinion for Application No. PCT/GB2019/052510, dated Jan. 14, 2020, 25 pages.
Partial ISR for Application No. PCT/GB2020/050013 dated May 19, 2020 (16 pages).
Search report for PCT/GB2015/052507 dated Mar. 11, 2020 (19 pages).
Search report for PCT/GB2015/052916 dated Feb. 26, 2020 (18 pages).
Notice of Allowance in U.S. Appl. No. 15/210,661 dated Jun. 17, 2020 (22 pages).
Notice of Allowance dated Jun. 17, 2020 for U.S. Appl. No. 15/210,661 (pp. 1-9).
"Welcome to Project Soli" video, https://atap.google.com/#project-soli Accessed Nov. 30, 2018, 2 pages.
A. Sand, Head-Mounted Display with Mid-Air Tactile Feedback, Proceedings of the 21st ACM Symposium on Virtual Reality Software and Technology, Nov. 13-15, 2015 (8 pages).
Alexander, J. et al. (2011), Adding Haptic Feedback to Mobile TV (6 pages).
Benjamin Long et al, "Rendering volumetric haptic shapes in mid-air using ultrasound", ACM Transactions on Graphics (TOG), ACM, US, (Nov. 19, 2014), vol. 33, No. 6, ISSN 0730-0301, pp. 1-10.
Casper et al., Realtime Control of Multiple-focus Phased Array Heating Patterns Based on Noninvasive Ultrasound Thermography, IEEE Trans Biomed Eng. Jan. 2012; 59(1): 95-105.
Colgan, A., "How Does the Leap Motion Controller Work?" Leap Motion, Aug. 9, 2014, 10 pages.
Corrected Notice of Allowability dated Jun. 21, 2019 for U.S. Appl. No. 15/966,213 (2 pages).
Corrected Notice of Allowability dated Oct. 31, 2019 for U.S. Appl. No. 15/623,516 (pp. 1-2).
Damn Geeky, "Virtual projection keyboard technology with haptic feedback on palm of your hand," May 30, 2013, 4 pages.
Definition of "Interferometry" according to Wikipedia, 25 pages., Retrieved Nov. 2018.
Definition of "Multilateration" according to Wikipedia, 7 pages., Retrieved Nov. 2018.
Definition of "Trilateration"according to Wikipedia, 2 pages., Retrieved Nov. 2018.
E. Bok, Metasurface for Water-to-Air Sound Transmission, Physical Review Letters 120, 044302 (2018) (6 pages).
E.S. Ebbini et al. (1991), A spherical-section ultrasound phased array applicator for deep localized hyperthermia, Biomedical Engineering, IEEE Transactions on (vol. 38 Issue: 7), pp. 634-643.
EPO Office Action for EP16708440.9 dated Sep. 12, 2018 (7 pages).
EPSRC Grant summary EP/J004448/1 (2011) (1 page).
Ex Parte Quayle Action dated Dec. 28, 2018 for U.S. Appl. No. 15/966,213 (pp. 1-7).
Extended European Search Report for Application No. EP19169929.7, dated Aug. 6, 2019, 7 pages.
Freeman et al., Tactile Feedback for Above-Device Gesture Interfaces: Adding Touch to Touchless Interactions ICMI'14, Nov. 12-16, 2014, Istanbul, Turkey (8 pages).
Gavrilov L R et al (2000) "A theoretical assessment of the relative performance of spherical phased arrays for ultrasound surgery" Ultrasonics, Ferroelectrics, and Frequency Control, IEEE Transactions on (vol. 47, Issue: 1), pp. 125-139.
Gavrilov, L.R. (2008) "The Possibility of Generating Focal Regions of Complex Configurations in Application to the Problems of Stimulation of Human Receptor Structures by Focused Ultrasound" Acoustical Physics, vol. 54, No. 2, pp. 269-278.
Gokturk, et al., "A Time-of-Flight Depth Sensor-System Description, Issues and Solutions," Published in: 2004 Conference on Computer Vision and Pattern Recognition Workshop, Date of Conference: Jun. 27-Jul. 2, 2004, 9 pages.

(56) References Cited

OTHER PUBLICATIONS

Hasegawa, K. and Shinoda, H. (2013) "Aerial Display of Vibrotactile Sensation with High Spatial-Temporal Resolution using Large Aperture Airbourne Ultrasound Phased Array", University of Tokyo (6 pages).
Hoshi T et al, "Noncontact Tactile Display Based on Radiation Pressure of Airborne Ultrasound", IEEE Transactions on Haptics, IEEE, USA, (Jul. 1, 2010), vol. 3, No. 3, ISSN 1939-1412, pp. 155-165.
Hoshi, T., Development of Aerial-Input and Aerial-Tactile-Feedback System, IEEE World Haptics Conference 2011, p. 569-573.
Hoshi, T., Handwriting Transmission System Using Noncontact Tactile Display, IEEE Haptics Symposium 2012 pp. 399-401.
Hoshi, T., Non-contact Tactile Sensation Synthesized by Ultrasound Transducers, Third Joint Euro haptics Conference and Symposium on Haptic Interfaces for Virtual Environment and Teleoperator Systems 2009 (5 pages).
Hoshi, T., Touchable Holography, SIGGRAPH 2009, New Orleans, Louisiana, Aug. 3-7, 2009. (1 page).
Iddan, et al., "3D Imaging in the Studio (and Elsewhere . . . " Apr. 2001, 3DV systems Ltd., Yokneam, Isreal, www.3dvsystems.com.il, 9 pages.
International Preliminary Report on Patentability and Written Opinion issued in corresponding PCT/US2017/035009, dated Dec. 4, 2018, 8 pages.
International Preliminary Report on Patentability for Application No. PCT/EP2017/069569 dated Feb. 5, 2019, 11 pages.
International Search Report and Written Opinion for Application No. PCT/GB2018/053739, dated Jun. 4, 2019, 16 pages.
International Search Report and Written Opinion for Application No. PCT/GB2019/050969, dated Jun. 13, 2019, 15 pages.
Iwamoto et al. (2008), Non-contact Method for Producing Tactile Sensation Using Airborne Ultrasound, EuroHaptics, pp. 504-513.
Iwamoto et al., Airborne Ultrasound Tactile Display: Supplement, The University of Tokyo 2008 (2 pages).
Iwamoto T et al, "Two-dimensional Scanning Tactile Display using Ultrasound Radiation Pressure", Haptic Interfaces for Virtual Environment and Teleoperator Systems, 20 06 14th Symposium on Alexandria, VA, USA Mar. 25-26, 2006, Piscataway, NJ, USA,IEEE, (Mar. 25, 2006), ISBN 978-1-4244-0226-7, pp. 57-61.
Japanese Office Action (with English language translation) for Application No. 2017-514569, dated Mar. 31, 3019, 10 pages.
K. Jia, Dynamic properties of micro-particles in ultrasonic transportation using phase-controlled standing waves, J. Applied Physics 116, No. 16 (2014) (12 pages).
Kamakura, T. and Aoki, K. (2006) "A Highly Directional Audio System using a Parametric Array in Air" WESPAC IX 2006 (8 pages).
Kolb, et al., "Time-of-Flight Cameras in Computer Graphics," Computer Graphics forum, vol. 29 (2010), No. 1, pp. 141-159.
Krim, et al., "Two Decades of Array Signal Processing Research—The Parametric Approach", IEEE Signal Processing Magazine, Jul. 1996, pp. 67-94.
Lang, Robert, "3D Time-of-Flight Distance Measurement with Custom Solid-State Image Sensors in CMOS/CCD—Technology", A dissertation submitted to Department of EE and CS at Univ. of Siegen, dated Jun. 28, 2000, 223 pages.
Li, Larry, "Time-of-Flight Camera—An Introduction," Texas Instruments, Technical White Paper, SLOA190B—Jan. 2014 Revised May 2014, 10 pages.
Light, E.D., Progress in Two Dimensional Arrays for Real Time Volumetric Imaging, 1998 (17 pages).
M. Barmatz et al, "Acoustic radiation potential on a sphere in plane, cylindrical, and spherical standing wave fields", The Journal of the Acoustical Society of America, New York, NY, US, (Mar. 1, 1985), vol. 77, No. 3, pp. 928-945, XP055389249.
M. Toda, New Type of Matching Layer for Air-Coupled Ultrasonic Transducers, IEEE Transactions on Ultrasonics, Ferroelecthcs, and Frequency Control, vol. 49, No. 7, Jul. 2002 (8 pages).
Marco A B Andrade et al, "Matrix method for acoustic levitation simulation", IEEE Transactions on Ultrasonics, Ferroelectrics and Frequency Control, IEEE, US, (Aug. 1, 2011), vol. 58, No. 8, ISSN 0885-3010, pp. 1674-1683.
Marshall, M ., Carter, T., Alexander, J., & Subramanian, S. (2012). Ultratangibles: creating movable tangible objects on interactive tables. In Proceedings of the 2012 ACM annual conference on Human Factors in Computing Systems, (pp. 2185-2188).
Marzo et al., Holographic acoustic elements for manipulation of levitated objects, Nature Communications DOI: I0.1038/ncomms9661 (2015) (7 pages).
Meijster, A., et al., "A General Algorithm for Computing Distance Transforms in Linear Time," Mathematical Morphology and its Applications to Image and Signal Processing, 2002, pp. 331-340.
Mingzhu Lu et al. (2006) Design and experiment of 256-element ultrasound phased array for noninvasive focused ultrasound surgery, Ultrasonics, vol. 44, Supplement, Dec. 22, 2006, pp. e325-e330.
Notice of Allowance dated Dec. 19, 2018 for U.S. Appl. No. 15/665,629 (pp. 1-9).
Notice of Allowance dated Dec. 21, 2018 for U.S. Appl. No. 15/983,864 (pp. 1-7).
Notice of Allowance dated Feb. 7, 2019 for U.S. Appl. No. 15/851,214 (pp. 1-7).
Notice of Allowance dated Jul. 31, 2019 for U.S. Appl. No. 15/851,214 (pp. 1-9).
Notice of Allowance dated Jul. 31, 2019 for U.S. Appl. No. 16/296,127 (pp. 1-9).
Notice of Allowance dated May 30, 2019 for U.S. Appl. No. 15/966,213 (pp. 1-9).
Obrist et al., Emotions Mediated Through Mid-Air Haptics, CHI 2015, Apr. 18-23, 2015, Seoul, Republic of Korea. (10 pages).
Obrist et al., Talking about Tactile Experiences, CHI 2013, Apr. 27-May 2, 2013 (10 pages).
Office Action dated Apr. 18, 2019 for U.S. Appl. No. 16/296,127 (pp. 1-6).
Office Action dated Apr. 4, 2019 for U.S. Appl. No. 15/897,804 (pp. 1-10).
Office Action dated Aug. 22, 2019 for U.S. Appl. No. 16/160,862 (pp. 1-5).
Office Action dated Feb. 20, 2019 for U.S. Appl. No. 15/623,516 (pp. 1-8).
Office Action dated Jul. 10, 2019 for U.S. Appl. No. 15/210,661 (pp. 1-12).
Office Action dated Jul. 26, 2019 for U.S. Appl. No. 16/159,695 (pp. 1-8).
Office Action dated May 16, 2019 for U.S. Appl. No. 15/396,851 (pp. 1-7).
Office Action dated Oct. 17, 2019 for U.S. Appl. No. 15/897,804 (pp. 1-10).
Office Action dated Oct. 31, 2019 for U.S. Appl. No. 15/671,107 (pp. 1-6).
Office Action dated Oct. 7, 2019 for U.S. Appl. No. 15/396,851 (pp. 1-9).
Oscar Martínez-Graullera et al, "2D array design based on Fermat spiral for ultrasound imaging", Ultrasonics, (Feb. 1, 2010), vol. 50, No. 2, ISSN 0041-624X, pp. 280-289, XP055210119.
PCT Partial International Search Report for Application No. PCT/GB2018/053404 dated Feb. 25, 2019, 13 pages.
Péter Tamás Kovács et al, "Tangible Holographic 3D Objects with Virtual Touch", Interactive Tabletops & Surfaces, ACM, 2 Penn Plaza, Suite 701 New York NY 10121-0701 USA, (Nov. 15, 2015), ISBN 978-1-4503-3899-8, pp. 319-324.
Phys.org, Touchable Hologram Becomes Reality, Aug. 6, 2009, by Lisa Zyga (2 pages).
Pompei, F.J. (2002), "Sound from Ultrasound: The Parametric Array as an Audible Sound Source", Massachusetts Institute of Technology (132 pages).
Schmidt, Ralph, "Multiple Emitter Location and Signal Parameter Estimation" IEEE Transactions of Antenna and Propagation, vol. AP-34, No. 3, Mar. 1986, pp. 276-280.
Search report and Written Opinion of ISA for PCT/GB2015/050417 dated Jul. 8, 2016 (20 pages).

(56) References Cited

OTHER PUBLICATIONS

Search report and Written Opinion of ISA for PCT/GB2015/050421 dated Jul. 8, 2016 (15 pages).
Search report and Written Opinion of ISA for PCT/GB2017/050012 dated Jun. 8, 2017. (18 pages).
Search Report for GB1308274.8 dated Nov. 11, 2013. (2 pages).
Search Report for GB1415923.0 dated Mar. 11, 2015. (1 page).
Search Report for PCT/GB/2017/053729 dated Mar. 15, 2018 (16 pages).
Search Report for PCT/GB/2017/053880 dated Mar. 21, 2018. (13 pages).
Search report for PCT/GB2014/051319 dated Dec. 8, 2014 (4 pages).
Search report for PCT/GB2015/052578 dated Oct. 26, 2015 (12 pages).
Search Report for PCT/GB2017/052332 dated Oct. 10, 2017 (12 pages).
Search report for PCT/GB2018/051061 dated Sep. 26, 2018 (17 pages).
Search report for PCT/US2018/028966 dated Jul. 13, 2018 (43 pages).
Sixth Sense webpage, http://www.pranavmistry.com/projects/sixthsense/ Accessed Nov. 30, 2018, 7 pages.
Steve Guest et al., "Audiotactile interactions in roughness perception", Exp. Brain Res (2002) 146:161-171, DOI 10.1007/s00221-002-1164-z, Accepted: May 16, 2002/ Published online: Jul. 26, 2002, Springer-Verlag 2002, (11 pages).
Sylvia Gebhardt, Ultrasonic Transducer Arrays for Particle Manipulation (date unknown) (2 pages).
Takahashi Dean: "Ultrahaptics shows off sense of touch in virtual reality", Dec. 10, 2016 (Dec. 10, 2016), XP055556416, Retrieved from the Internet: URL: https://venturebeat.com/2016/12/10/ultrahaptics-shows-off-sense-of-touch-in-virtual-reality/ [retrieved on Feb. 13, 2019] 4 pages.
Takahashi, M. et al., Large Aperture Airborne Ultrasound Tactile Display Using Distributed Array Units, SICE Annual Conference 2010 p. 359-362.
Tom Carter et al, "UltraHaptics: Multi-Point Mid-Air Haptic Feedback for Touch Surfaces", Proceedings of the 26th Annual ACM Symposium on User Interface Software and Technology, UIST '13, New York, New York, USA, (Jan. 1, 2013), ISBN 978-1-45-032268-3, pp. 505-514.
Tom Nelligan and Dan Kass, Intro to Ultrasonic Phased Array (date unknown) (8 pages).
Wilson et al., Perception of Ultrasonic Haptic Feedback on the Hand: Localisation and Apparent Motion, CHI 2014, Apr. 26-May 1, 2014, Toronto, Ontario, Canada. (10 pages).
Xin Cheng et al, "Computation of the acoustic radiation force on a sphere based on the 3-D FDTD method", Piezoelectricity, Acoustic Waves and Device Applications (SPAWDA), 2010 Symposium on, IEEE, (Dec. 10, 2010), ISBN 978-1-4244-9822-2, pp. 236-239.
Xu Hongyi et al, "6-DoF Haptic Rendering Using Continuous Collision Detection between Points and Signed Distance Fields", IEEE Transactions on Haptics, IEEE, USA, vol. 10, No. 2, ISSN 1939-1412, (Sep. 27, 2016), pp. 151-161, (Jun. 16, 2017).
Yang Ling et al, "Phase-coded approach for controllable generation of acoustical vortices", Journal of Applied Physics, American Institute of Physics, US, vol. 113, No. 15, ISSN 0021-8979, (Apr. 21, 2013), pp. 154904-154904.
Yoshino, K. and Shinoda, H. (2013), "Visio Acoustic Screen for Contactless Touch Interface with Tactile Sensation", University of Tokyo (5 pages).
Zeng, Wejun, "Microsoft Kinect Sensor and Its Effect," IEEE Multimedia, Apr.-Jun. 2012, 7 pages.
Office Action dated Jun. 19, 2020 for U.S. Appl. No. 16/699,629 (pp. 1-12).
Office Action dated Jun. 25, 2020 for U.S. Appl. No. 16/228,767 (pp. 1-27).
Office Action dated Jul. 9, 2020 for U.S. Appl. No. 16/228,760 (pp. 1-17).
ISR and WO for PCT/GB2020/050926 (Jun. 2, 2020) (16 pages).
Mueller, GANerated Hands for Real-Time 3D Hand Tracking from Monocular RGB, Eye in-Painting with Exemplar Generative Adversarial Networks, pp. 49-59 (Jun. 1, 2018).
Seungryul, Pushing the Envelope for RGB-based Dense 3D Hand Pose Estimation for RGB-based Desne 3D Hand Pose Estimation via Neural Rendering, arXiv:1904.04196v2 [cs.CV] Apr. 9, 2019 (5 pages).
ISR and WO for PCT/GB2020/050013 (Jul. 13, 2020) (20 pages).
Bożena Smagowska & Małgorzata Pawlaczyk-Łuszczyńska (2013) Effects of Ultrasonic Noise on the Human Body—A Bibliographic Review, International Journal of Occupational Safety and Ergonomics, 19:2, 195-202.
Office Action dated Sep. 18, 2020 for U.S. Appl. No. 15/396,851 (pp. 1-14).
Office Action dated Sep. 21, 2020 for U.S. Appl. No. 16/198,959 (pp. 1-17).
Notice of Allowance dated Sep. 30, 2020 for U.S. Appl. No. 16/401,148 (pp. 1-10).
Notice of Allowance dated Oct. 1, 2020 for U.S. Appl. No. 15/897,804 (pp. 1-9).
Notice of Allowance dated Oct. 6, 2020 for U.S. Appl. No. 16/699,629 (pp. 1-8).
Notice of Allowance dated Oct. 16, 2020 for U.S. Appl. No. 16/159,695 (pp. 1-7).
Notice of Allowance dated Oct. 30, 2020 for U.S. Appl. No. 15/839,184 (pp. 1-9).
Teixeira, et al., "A brief introduction to Microsoft's Kinect Sensor," Kinect, 26 pages, retrieved Nov. 2018.
Georgiou et al., Haptic In-Vehicle Gesture Controls, Adjunct Proceedings of the 9th International ACM Conference on Automotive User Interfaces and Interactive Vehicular Applications (AutomotiveUI '17), Sep. 24-27, 2017 (6 pages).
Large et al.,Feel the noise: Mid-air ultrasound haptics as a novel human-vehicle interaction paradigm, Applied Ergonomics (2019) (10 pages).
Rocchesso et al.,Accessing and Selecting Menu Items by In-Air Touch, ACM CHItaly'19, Sep. 23-25, 2019, Padova, Italy (9 pages).
Shakeri, G., Williamson, J. H. and Brewster, S. (2018) May the Force Be with You: Ultrasound Haptic Feedback for Mid-Air Gesture Interaction in Cars. In: 10th International ACM Conference on Automotive User Interfaces and Interactive Vehicular Applications (AutomotiveUI 2018) (11 pages).
Imaginary Phone: Learning Imaginary Interfaces by Transferring Spatial Memory From a Familiar Device Sean Gustafson, Christian Holz and Patrick Baudisch. UIST 2011. (10 pages).
Aoki et al., Sound location of stero reproduction with parametric loudspeakers, Applied Acoustics 73 (2012) 1289-1295 (7 pages).
Bajard et al., BKM: A New Hardware Algorithm for Complex Elementary Functions, 8092 IEEE Transactions on Computers 43 (1994) (9 pages).
Bajard et al., Evaluation of Complex Elementary Functions / A New Version of BKM, SPIE Conference on Advanced Signal Processing, Jul. 1999 (8 pages).
Bortoff et al., Pseudolinearization of the Acrobot using Spline Functions, IEEE Proceedings of the 31st Conference on Decision and Control, Sep. 10, 1992 (6 pages).
Corrected Notice of Allowability dated Jan. 14, 2021 for U.S. Appl. No. 15/897,804 (pp. 1-2).
ISR and WO for PCT/GB2020/052544 (Dec. 18, 2020) (14 pages).
ISR and WO for PCT/GB2020/052545 (Jan. 27, 2021) (14 pages).
ISR and WO for PCT/GB2020/052829 (Feb. 1, 2021) (15 pages).
Office Action dated Mar. 11, 2021 for U.S. Appl. No. 16/228,767 (pp. 1-23).
Search Report by EPO for EP 17748466 dated Jan. 13, 2021 (16 pages).
Wang et al., Device-Free Gesture Tracking Using Acoustic Signals, ACM MobiCom '16, pp. 82-94 (13 pages).
Office Action dated Mar. 31, 2021 for U.S. Appl. No. 16/228,760 (pp. 1-21).
ISR and WO for PCT/GB2020/052544 (dated Dec. 18, 2020) (14 pages).

(56) References Cited

OTHER PUBLICATIONS

ISR & WO for PCT/GB2020/052545 (dated Jan. 27, 2021) 14 pages.
Hoshi et al., Tactile Presentation by Airborne Ultrasonic Oscillator Array, , Proceedings of Robotics and Mechatronics Lecture 2009, Japan Society of Mechanical Engineers; May 24, 2009 (5 pages).
Office Action dated May 14, 2021 for U.S. Appl. No. 16/198,959 (pp. 1-6).
Office Action dated May 13, 2021 for U.S. Appl. No. 16/600,500 (pp. 1-9).
ISR for PCT/GB2020/053373 (dated Mar. 26, 2021) (16 pages).
ISR for PCT/GB2020/052546 (dated Feb. 23, 2021) (14 pages).
Notice of Allowance dated Jun. 10, 2021 for U.S. Appl. No. 17/092,333 (pp. 1-9).
Notice of Allowance dated Jun. 25, 2021 for U.S. Appl. No. 15/396,851 (pp. 1-10).
Office Action dated Jun. 25, 2021 for U.S. Appl. No. 16/899,720 (pp. 1-5).

* cited by examiner

ULTRASONIC-ASSISTED LIQUID MANIPULATION

RELATED APPLICATION

This application claims the benefit of the following U.S. Provisional Patent Applications, which is incorporated by reference in its entirety:

1) Serial No. 62/728,829, filed on Sep. 9, 2018.

FIELD OF THE DISCLOSURE

The present disclosure relates generally to improved techniques for manipulation of liquids using ultrasonic signals.

BACKGROUND

A continuous distribution of sound energy, which we will refer to as an "acoustic field", can be used for a range of applications including haptic feedback in mid-air.

High-powered ultrasound is well known in the food-drying market. The sound-energy is pumped into the bulk of the fruit/vegetables directly either through a coupling medium (that may be oil-based) or through the air in a resonator (to avoid too much loss). This results in a measurable increase in drying speed. There are various theories attempting to explain the phenomena (discussed below).

More generally, liquid manipulation without direct contact may be used in manufacturing techniques which that soluble materials. This avoids contamination or corrosion that could substantially improve manufacturing efficiencies.

Hand-drying is a common aspect of public restrooms across the world. Forced air dryers are hygienic and energy-efficient but often too slow or loud for many users. These people often resort to wasteful paper towels. If it was possible to speed drying or make it relatively quiet, this would increase usage rates and lower costs associated with maintaining the restroom.

SUMMARY

A phased array of ultrasonic transducers may create arbitrary fields that can be utilized to manipulate fluids. This includes the translation of drops on smooth surfaces as well speeding the evaporation of fluids on wetted hands. Ultrasound signals may be used to manipulate liquids by interacting with the resulting acoustic pressure field.

Proposed herein is the use airborne ultrasound focused to the surface of the hand. The risk is that coupling directly into the bulk of the hand may cause damage to the cellular material through heating, mechanical stress, or cavitation. Using a phased array, the focus may be moved around, thus preventing acoustic energy from lingering too long on one particular position of the hand. While some signaling may penetrate into the hand, most of the energy (99.9%) is reflected. Methods are discussed to couple just to the wetted surface of the hand as well.

BRIEF DESCRIPTION OF THE DRAWINGS

The accompanying figures, where like reference numerals refer to identical or functionally similar elements throughout the separate views, together with the detailed description below, are incorporated in and form part of the specification, serve to further illustrate embodiments of concepts that include the claimed invention and explain various principles and advantages of those embodiments.

Figure 1:
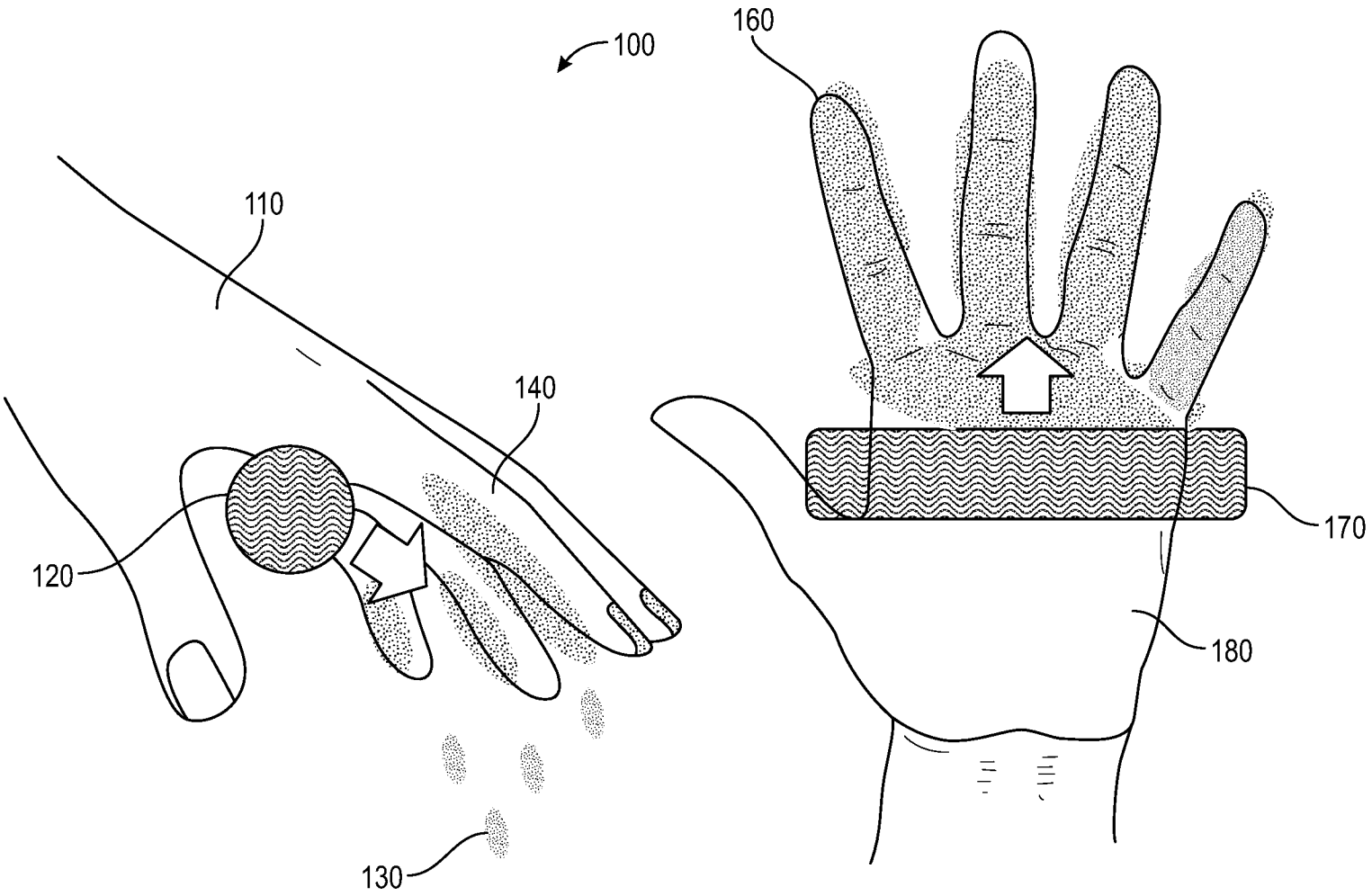
FIG. 1 is a schematic showing acoustic fields pushing water towards the tips of the fingers so that it can pool and fall away.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Airborne ultrasound is composed of longitudinal pressure waves at frequencies beyond the range of human hearing. These waves carry energy and can be used to excite waves in other objects (such as create haptic feedback on skin) and do mechanical work (such as levitating or pushing objects).

I. Using Ultrasonic Fields to Manipulate Liquids

The nonlinear pressure field created at high ultrasonic sound pressure level (SPL) includes a static pressure component. This pressure can be used to manipulate liquid droplets on surfaces which are at least slightly phobic to that liquid (for instance hydrophobic surfaces and water). If a focus point is created near a droplet, the droplet will be repulsed. This is a method for translating this droplet without direct contact.

In embodiments of this invention, a phased array of ultrasonic transducers is placed nearby the surface of interaction and creates a field on that surface with high-pressure regions used to push drops or liquid channels. These regions may be arbitrarily shaped and may be manipulated dynamically to achieve the desired translation. With enough resolution (i.e., high-frequency) drops may be diced into sub-drops and separated in a controlled manner. Further, directing a focus point of the phased array to the surface of a liquid that is at least a few wavelengths deep can cause the capture of gas droplets from the nearby gas interface. This can be used to mix gasses into the liquid or simply help agitate/mix the solution.

It has recently been discovered that high-intensity airborne ultrasound can effectively speed up the drying process for fruits and vegetables. The process can involve high temperatures (up to 70° C.) but this is not required. In fact, ultrasound makes the largest difference when drying at lower temperatures.

In embodiments of this invention, ultrasonic-assisted drying may be used to speed the de-wetting of hands in a safe and controlled manner.

Turning to FIG. 1, shown is a schematic 100 of two hands interacting with moving ultrasonic fields. On the left, dry skin 110 is formed when a moving sound field 120 of a generally circular shape "pushes" drops 130 off the hand. On the right, dry skin 180 is formed when a moving sound field 170 of a generally rectangular shape "pushes" wetness 160 off the hand.

In this arrangement, acoustic pressure may be used to manipulate a thin film of water on a wetted hand much as it may manipulate fluids on a surface described above. An acoustic focal area, which may be made into any shape such as a point or line, is translated to push the water film off the hand even as the hand itself is moving. The de-wetting process may be accomplished by bunching enough water together (for instance near the fingertips) when the hand is pointed down, so that it forms a droplet and falls away (left side). Alternatively, this technique may be paired with forced air so that the ultrasound pressure pushes the wetted film towards areas with the highest (or most effective) forced air (right side).

There are two primary mechanisms beyond the physical pushing of water that may assist drying: enhanced mass-transfer and atomization. One or both of these drying-assist mechanisms may be exploited in various arrangements presented below.

For enhanced mass-transfer, during each cycle of sound there is alternating high-pressure and low-pressure that mechanically compresses and decompresses the medium. During the compression cycle, moisture is pushed out of compressible cavities like a sponge. During rarefaction, the water is pushed away by the expanding cavities instead of back into them. No longer trapped by the cavities, the water is free to flow along gradients to areas of lower moisture. This improves the ability of water to move in a semi-solid environment and brings water to the surface more quickly in a drying environment.

Atomization has been popularized as ultrasonic foggers. In these devices, high-intensity ultrasound is generated by a transducer submerged in water which excites capillary waves on the surface. At sufficient amplitude, the capillary waves become unstable and droplets are pinched off into the air forming a visible mist. In the context of drying, capillary wave-produced droplets effectively remove moisture from the surface of the object. The capillary wave-produced droplets may then be removed from the vicinity with gradients in pressure from one or more of: (a) a sound field; (b) forced air; and (c) heat-assisted evaporation (which is very effective due to the capillary wave-produced droplets high surface-area-to-volume ratio).

Both mass transfer enhancement and atomization are threshold phenomena. A focused sound field may create the necessary high-pressures without a sophisticated resonance chamber. In one arrangement of this invention, a phased array is placed near the user's hands and a focal point is created on the hand to promote mass transfer of moisture to the surface and atomization. Forced and/or heated air will further improve the drying speed if desired.

With the application of high intensity ultrasound comes mechanical heating and potential damage to the skin. Both mass transfer and atomization are fast phenomenon, taking only a few cycles of sound to start being effective. Mechanical heating, on the other hand, can take many cycles build up a damaging temperature. A phased array may translate the focal point to avoid any tissue damage. Drying would still be enhanced by crossing the pressure threshold for the dying phenomena while not lingering long enough to deposit a damaging amount of energy to the skin.

Of the two effects, atomization by capillary waves is preferred in the hand drying context as it forces moisture away from surface of the skin without heating the water or mechanically driving the medium. Capillary waves will be excited by any incident ultrasound. Optimal coupling, and therefore maximum atomization for a given sound pressure, may be achieved through specific arrangements of the sound field (described below). In these arrangements, some enhancement by mass transfer will be inevitable and will only help to speed the drying.

Figure 2:
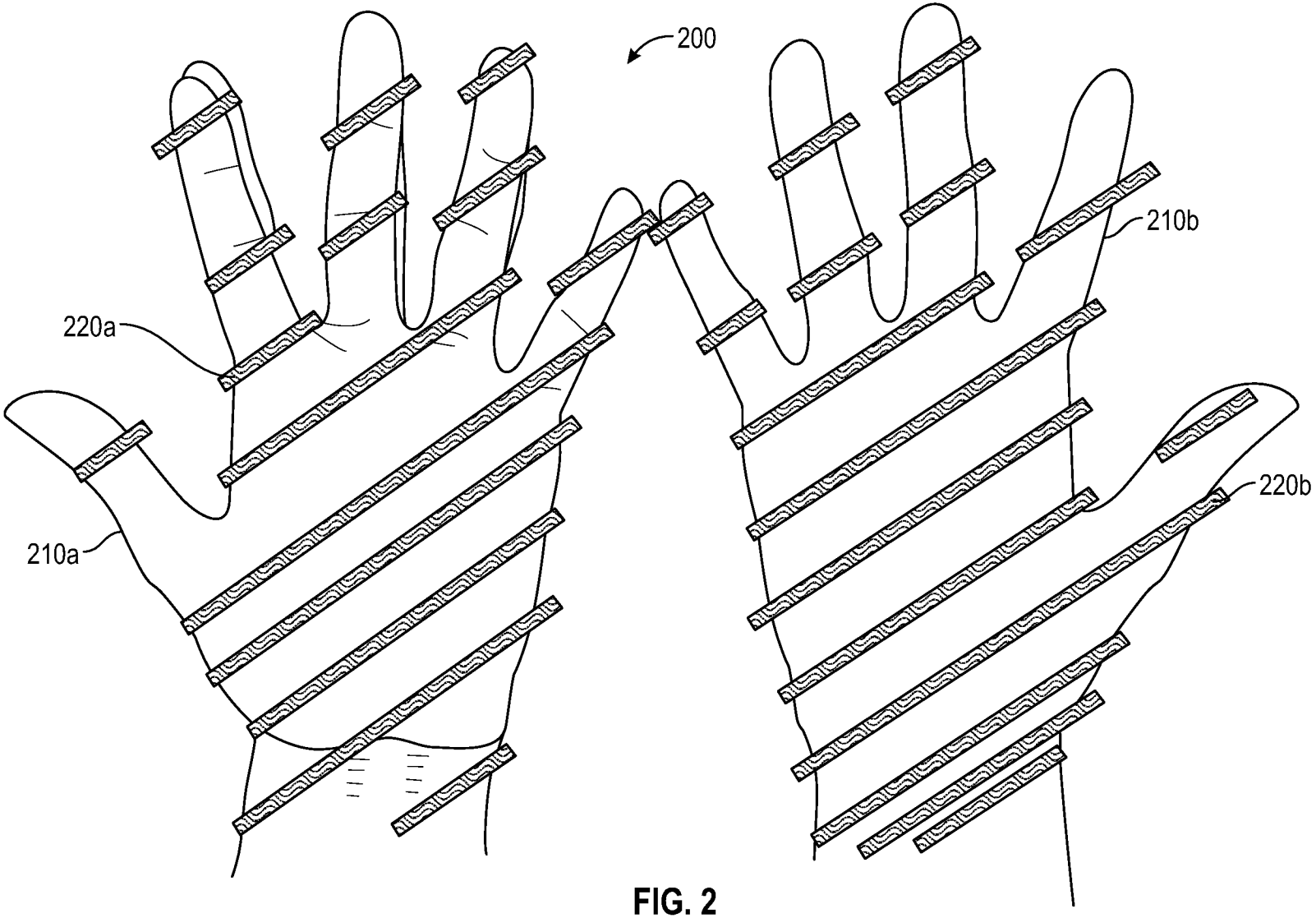
FIG. 2 is a schematic showing a moving pressure field pushes water towards the tips of each of the fingers to pool and fall away.

Turning to FIG. 2, shown is a schematic 200 of high-pressure, repeating focal regions that continually drain with an acoustic structure that behaves much like an Archimedes screw. A moving pressure field in the configuration of an Archimedes screw actively pushes water towards the tips of each of the fingers to pool and fall away. The left illustration shows the palm and front of the hand 210*a* with the lines of heightened pressure 220*a*, while the right side shows the back of the hand 210*b*, with the lines of force 220*b* winding around to move the liquid forward.

As the spiral pattern of high acoustic pressure turns around the wetted area as time moves forward, the "thread" of the Archimedean screw structure contains liquid that is propelled towards the edges. But if the spiral pattern is moved too quickly, the liquid will not react and drying time will increase. If the spiral pattern is moved too slowly, the liquid will move too slowly and drying time will increase.

An optimal speed of the spiral pattern may be calculated. Relative to sound waves in air, capillary waves are characterized by short wavelength and slow speed. For wavelengths short relative to the depth of the fluid, capillary waves can be described by the following dispersion relation:

$$\omega^2 = \frac{\alpha k^3}{\rho} \tag{1}$$

where ω is the angular frequency, k is the wave number, a is the surface tension and p is the density of the fluid. At 40 kHz, a typical frequency for airborne ultrasound, the wavelength in air is about 8.5 mm with a propagation speed of 343 m/s under normal conditions. For the same frequency, capillary waves have a wavelength of 0.066 mm with a propagation speed of 2.6 m/s given by equation 1. This illustrates the difficulty in creating efficient coupling between the two systems.

Diffraction limits the ability of any monochromatic system to create features smaller than the wavelength. In fact, any high-pressure finite focal region will contain higher frequency components near its edges due to spatial frequencies and nonlinear effects. If these higher frequency points, lines or regions are translated at the correct speed to match the desired capillary mode speed (such as 2.6 m/s for plane waves given above), this will increase coupling to that mode. In one arrangement, the higher frequency regions may be focus points or lines that move at capillary speeds. Ideally, these regions would spend more time in locations with more water concentration.

Figure 3A:
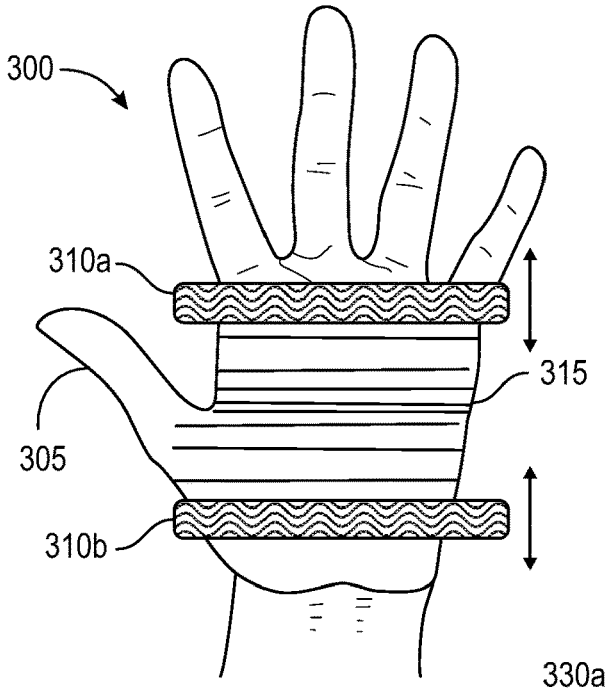
FIGS. 3A. 3B and 3C are schematics showing oscillating pressure fields that launch capillary waves into a convergence point of highest pressure.
Figure 3B:
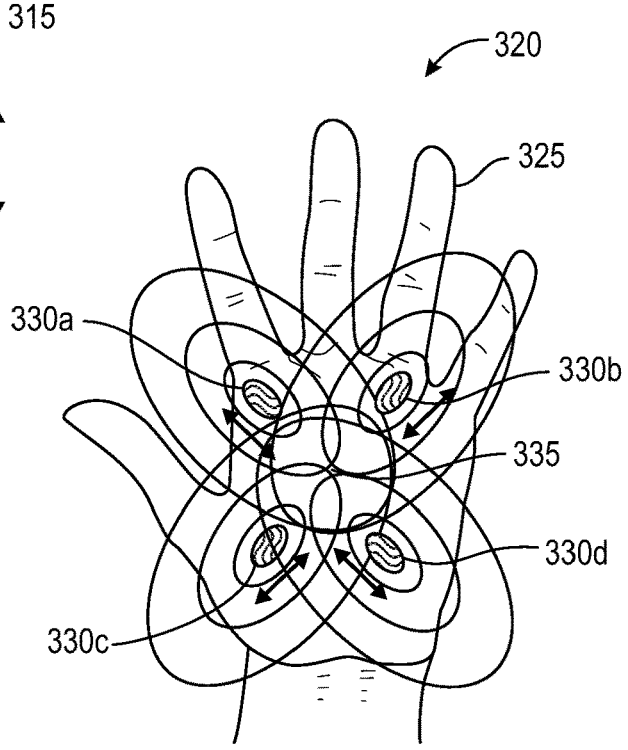
Figure 3C:
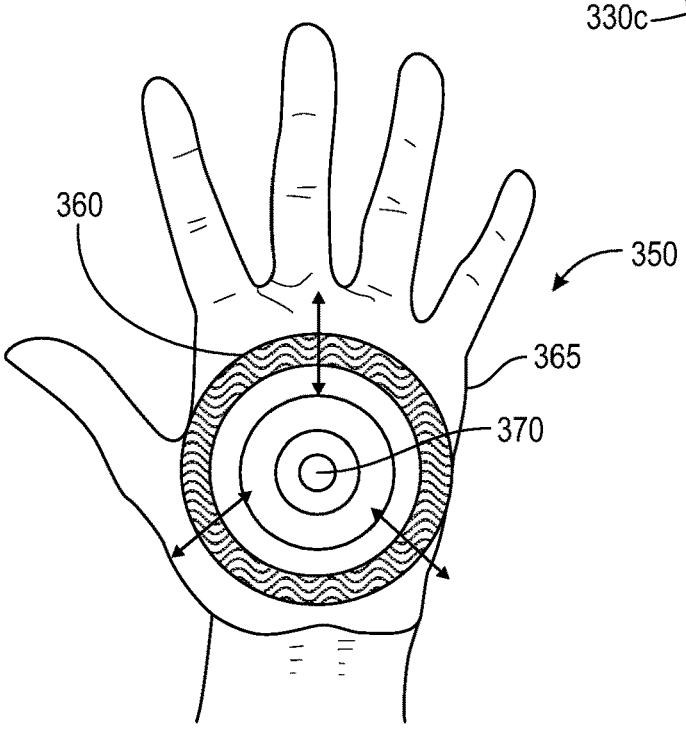

Turning to FIGS. 3A, 3B and 3C, shown are examples of one or more focal regions that may be designed to create converging capillary wave mode to further increase the amplitude of oscillation to a point necessary to create the pinch-off instability. These may take the form of oscillating points/regions that send capillary waves emanating away from them which then can interact and focus.

The figures show oscillating pressure fields that launch capillary waves into a convergence point of highest pressure. FIG. 3A shows a schematic 300 of a hand 305 where the focal regions 310*a*, 310*b* are rectangular shaped and operate vertically to converge at a center horizontal line 315 on the hand 305. FIG. 3B shows a schematic 320 of a hand 325 where the focal regions 330*a*, 330*b*, 330*c*, 330*d* are oval shaped and operate diagonally to converge at a center point 335 on the hand 325. FIG. 3C shows a schematic 350 of a hand 365 where the focal region 360 is circular shaped and operates radially to converge at a center point 370 on the hand 365.

Alternatively, single points or trains of points may propagate to one or more common centers pushing the capillary waves into a focus. Here, translating pressure fields launch capillary waves into a convergence point of highest pressure.

Figure 4A:
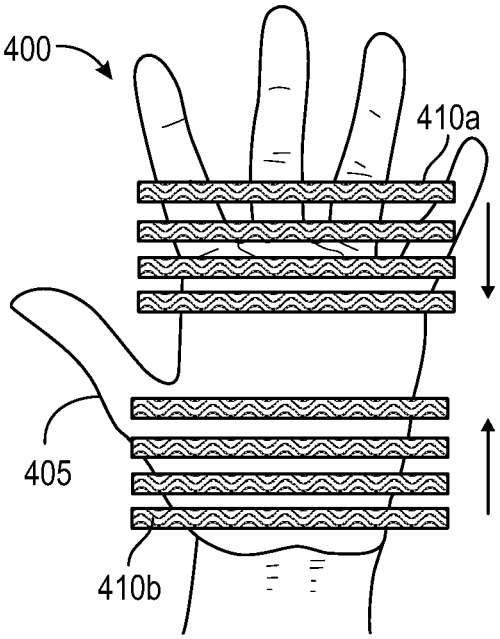
FIGS. 4A, 4B and 4C are schematics showing translating pressure fields that launch capillary waves into a convergence point of highest pressure.
Figure 4B:
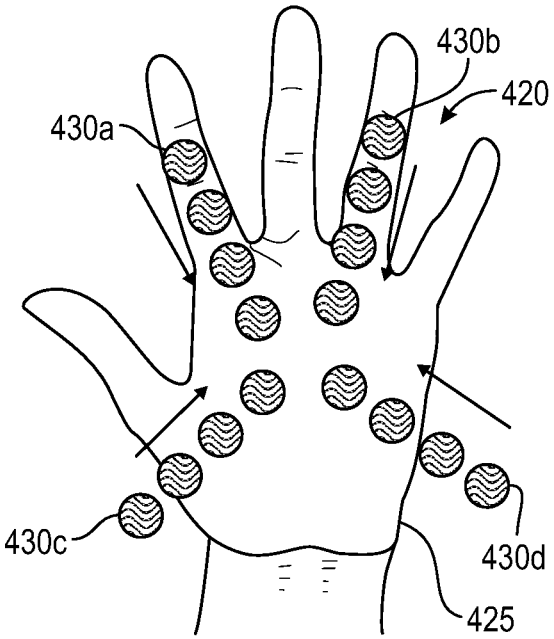
Figure 4C:
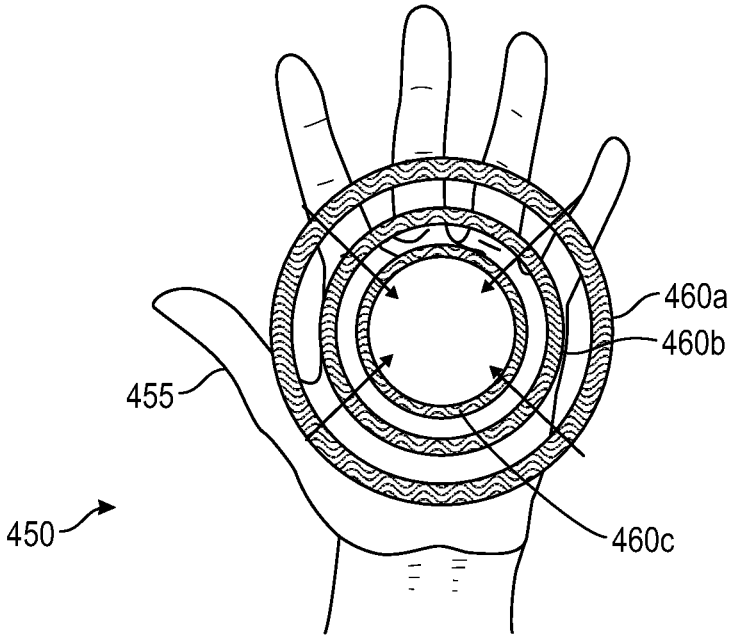

Turning to FIGS. 4A, 4B and 4C, shown are translating pressure fields on a hand that launch capillary waves into a convergence point of highest pressure. FIG. 4A shows a schematic 400 of a hand 405 where the pressure fields 410*a*, 410*b* are rectangular shaped and translate in a vertical direction. FIG. 4B shows a schematic 420 of a hand 425 where the focal regions 430*a*, 430*b*, 430*c*, 430*d* are circular shaped to translate in various diagonal directions. FIG. 4C shows a schematic 450 of a hand 455 where the pressure fields are circular shaped and translate in a radial direction.

In either of these two cases, the convergence point(s) are translated around in order to dry the entire hand.

Nonlinearities may be exploited to create repetitive features and overcome the diffraction limit. At high pressure, sound waves exhibit steepening whereby the high-pressure portion of the pressure wave moves slightly faster than the low-pressure portion. This eventually leads to the formation of shock waves.

This sharp region of pressure may be used (either before or after a true shock forms) to create sharp features by combining multiple wave fronts.

Figure 5A:
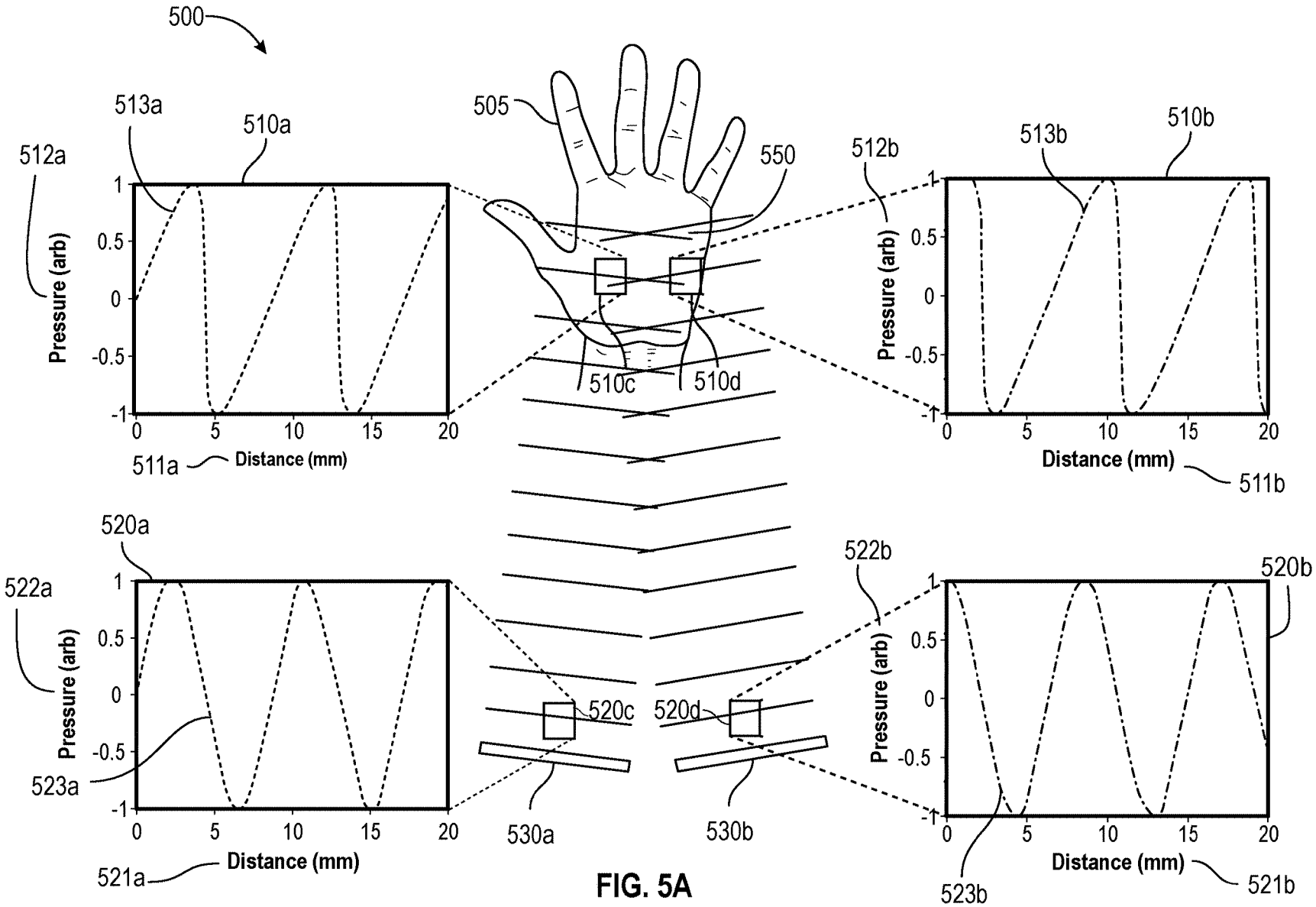
FIGS. 5A and 5B are schematics showing diagonal converging nonlinear pressure fields that yield sharp features.

Turning to FIGS. 5A, shown is a schematic 500 demonstrating the effect of diagonal converging nonlinear pressure fields that yield sharp features. A left pressure field 530*a* and a right pressure field 530*b* converge at a location 550 on a hand 505.

The plots of the bottom left graph 520*a* and the bottom right graph 520*b* show clean emitted waves that show no wave "tilting". The bottom left graph 520*a* shows a clean emitted wave 523*a* and is a close-up of waves at a location 520*c* within the left pressure field 530*a* relatively distant from the convergence location 550. The x-axis 521*a* shows distance in millimeters. The y-axis 522*a* shows pressure in arbitrary units. The bottom right graph 520*b* shows a clean emitted wave 523*b* and is a close-up of waves at a location 520*d* within the right pressure field 530*b* relatively distant from the convergence location 550. The x-axis 521*b* shows distance in millimeters. The y-axis 522*b* shows pressure in arbitrary units.

The top left graph 510*a* and the top right graph 510*b* show sound waves exhibit steepening whereby the high-pressure portion of the pressure wave moves slightly faster than the low-pressure portion. The plots in these graphs show wave "tilting" that result from the steepening.

Specifically, the top left graph 510*a* shows a steepened wave 513*a* (represented by a dashed line) that produces the left pressure field 530*a* and is a close-up of waves at a location 510*c* on or near the convergence location 550. The x-axis 511*a* shows distance in millimeters. The y-axis 512*a* shows pressure in arbitrary units.

The top right graph 510*b* shows a steepened wave 513*b* (represented by a dot-dashed line) that produces the right pressure field 530*b* and is a close-up of waves at a location 510*d* on or near the convergence location 550. The x-axis 511*b* shows distance in millimeters. The y-axis 512*b* shows pressure in arbitrary units.

Figure 5B:
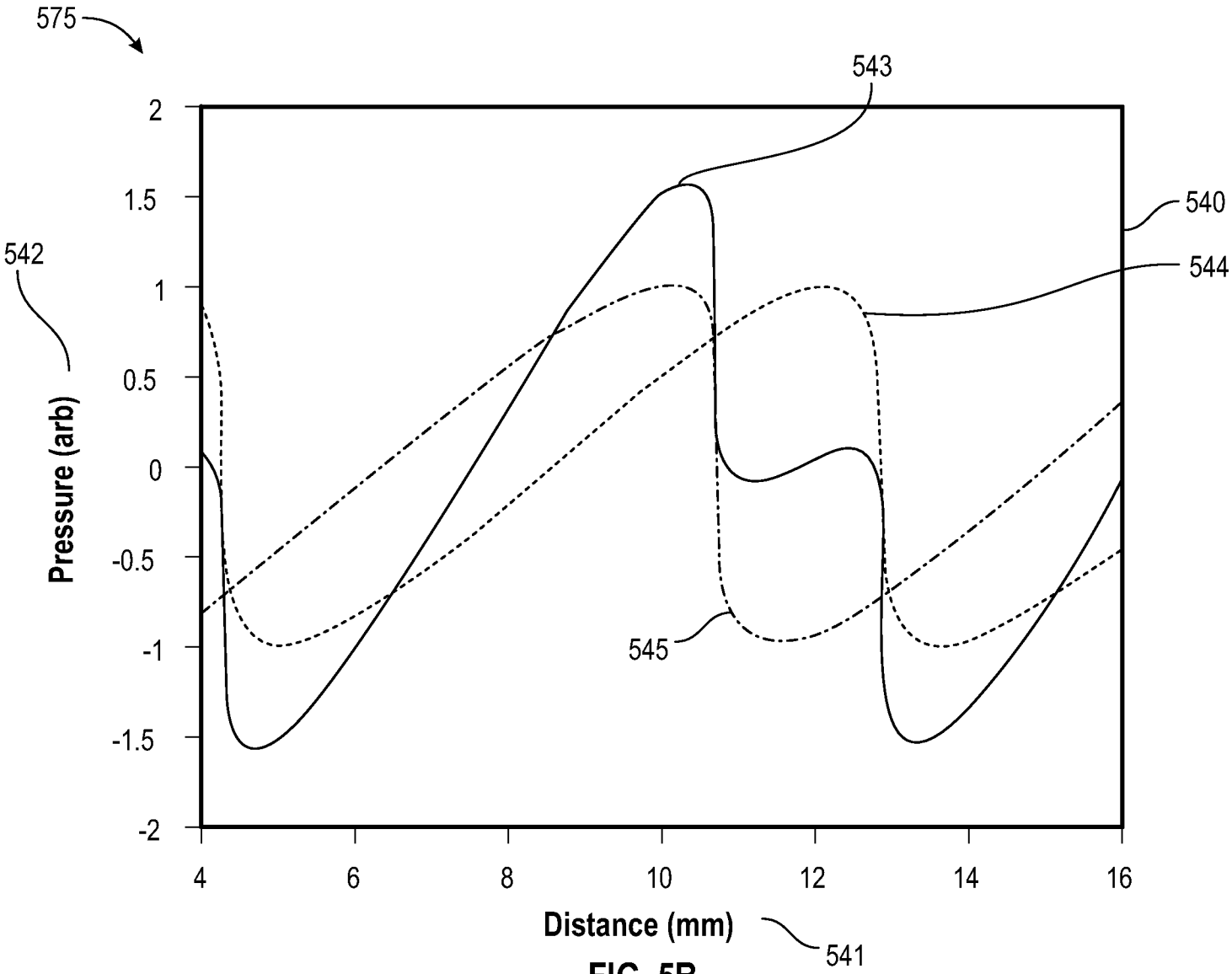

Turning to FIG. 5B, shown is a graph 575 that shows diagonal nonlinear pressure fields yield sharp features when they a converge at a location 550 on the hand 505. Like the graphs in FIG. 5A, the x-axis 541 shows distance in millimeters and the y-axis 542 shows pressure in arbitrary units. The plot of the dashed line 544 is equivalent to the left steepened wave shown in the plot of the top left graph 510*a* in FIG. 5A. The plot of the dot-dashed line 545 is equivalent to the right steepened wave shown in the plot of the top left graph 510*b* in FIG. 5A. The plot of the solid line 543 represents the cumulative effect of the two steepened waves 544, 545 at their convergence 550 on the hand 505. This solid line plot 543 shows the sharp features that may occur as a result of this convergence. In this example, the sharp features occur approximately between 11 to 13 millimeters of distance.

Figure 6A:
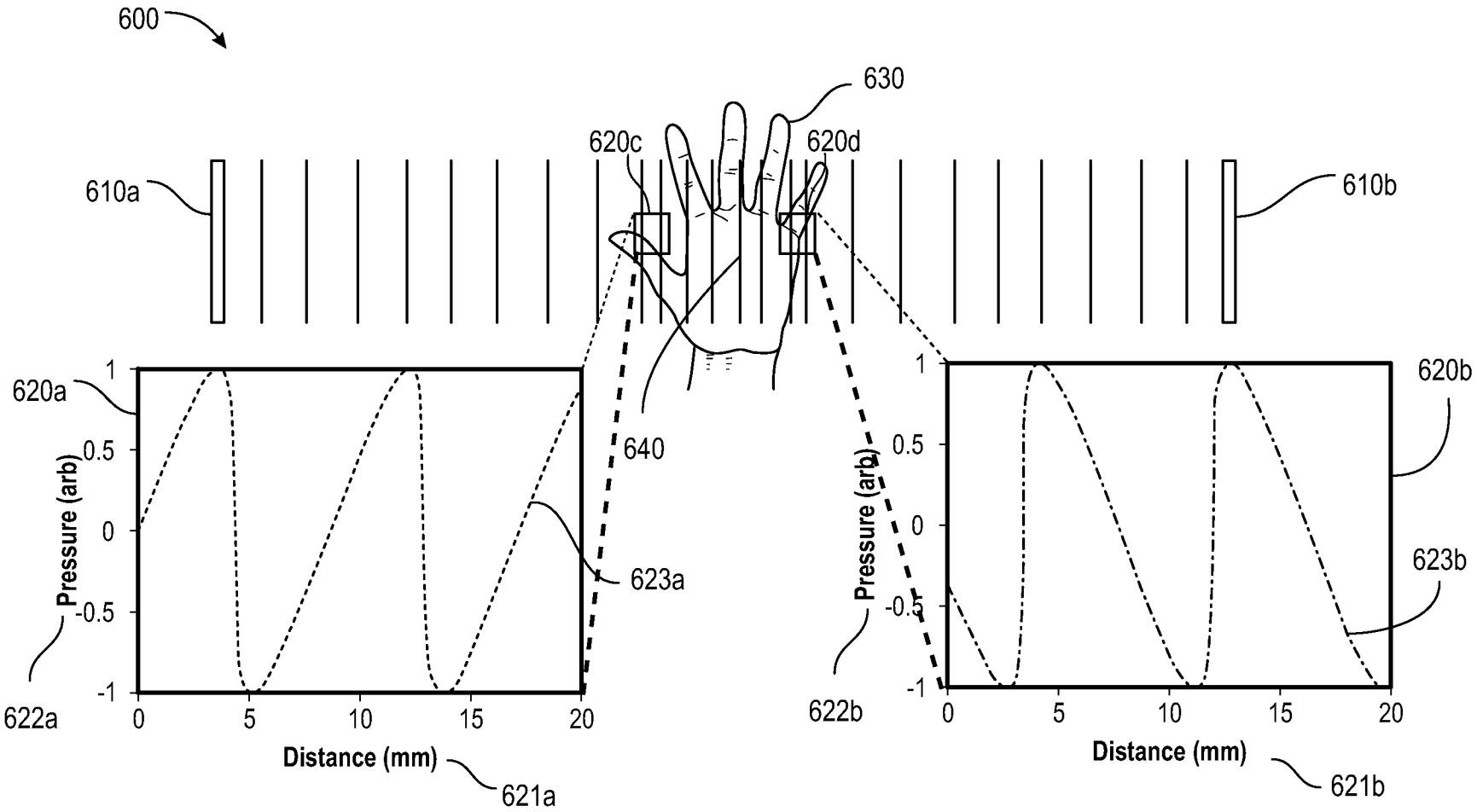
FIGS. 6A and 6B are schematics showing facing converging nonlinear pressure fields that yield sharp features.

Turning to FIGS. 6A, shown is a schematic 600 demonstrating the effect of facing nonlinear pressure fields that yield sharp features. A left pressure field 610*a* and a right pressure field 610*b* converge at a location 640 on a hand 630.

The left graph and the right graph show sound waves exhibit steepening whereby the high-pressure portion of the pressure wave moves slightly faster than the low-pressure portion. The plots in these graphs show wave "tilting" that result from the steepening.

Specifically, the left graph 620*a* shows a steepened wave 623*a* (represented by a dashed line) that produces the left pressure field 610*a* and is a close-up of waves at a location 620*c* on or near the convergence location 640. The x-axis 621*a* shows distance in millimeters. The y-axis 621*a* shows pressure in arbitrary units.

The right graph 620*b* shows a steepened wave 623*b* (represented by a dot-dashed line) that produces the right pressure field 610*b* and is a close-up of waves at a location 620*d* on or near the convergence location 640. The x-axis 621*b* shows distance in millimeters. The y-axis 621*b* shows pressure in arbitrary units.

Graphs corresponding to the bottom left graph 520*a* and bottom right graph 520*b* in FIG. 5A are not shown in FIG. 6A but would reflect similar data.

Figure 6B:
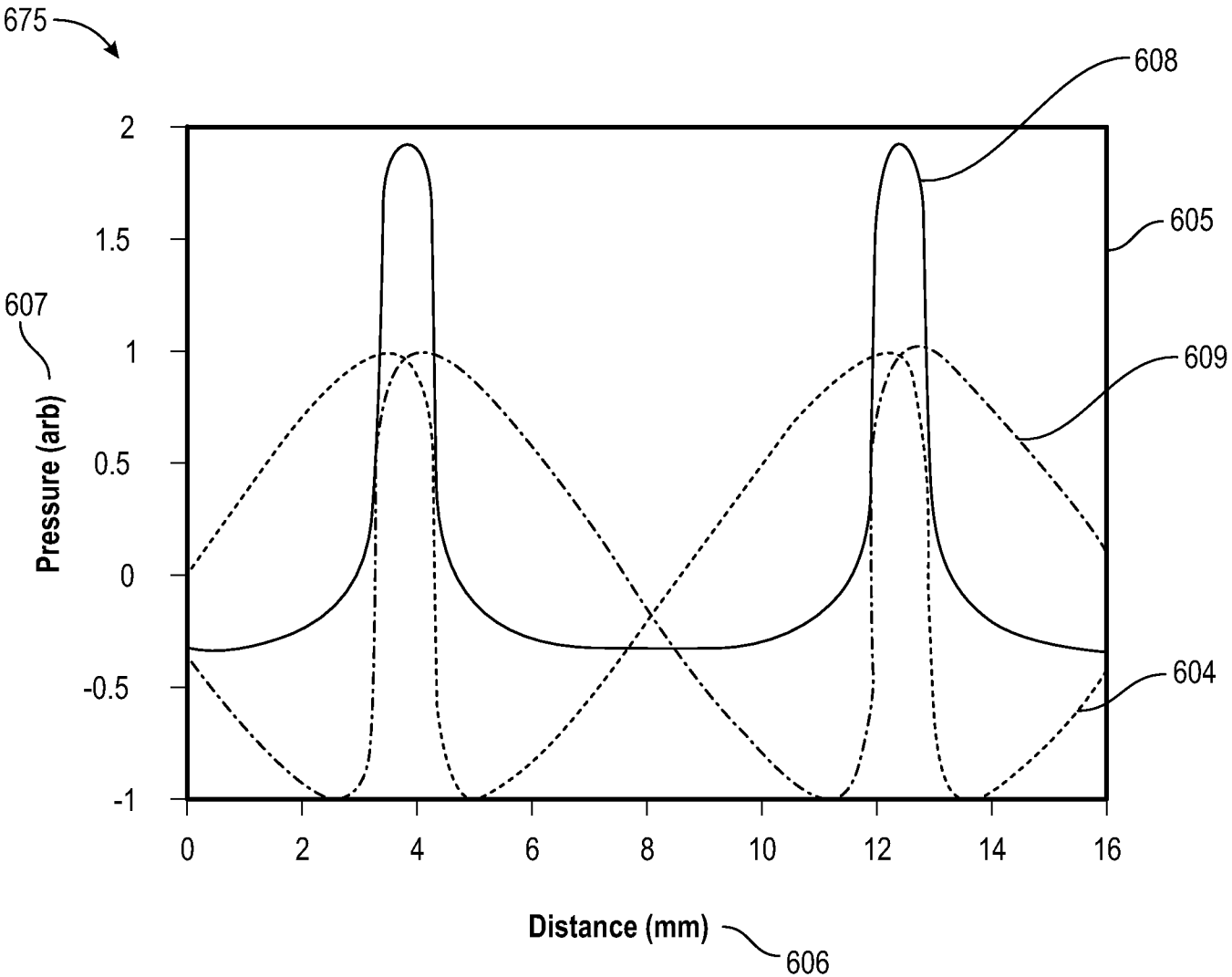

Turning to FIG. 6B, shown is a graph 675 that shows facing nonlinear pressure fields yield sharp features when they a converge at a location 640 on the hand 630. Like the graphs in FIG. 6A, the x-axis 606 shows distance in millimeters and the y-axis 607 shows pressure in arbitrary units. The plot of the dashed line 604 is equivalent to the left steepened wave shown in the plot of the left graph 602*a* in FIG. 6A. The plot of the dot-dashed line 609 is equivalent to the right steepened wave shown in the plot of the top left graph 602*b* in FIG. 6A. The plot of the solid line 608 represents the convergence of the steepened waves 604, 609. This solid line plot 608 shows the sharp features that may occur as a result of this convergence. In this example, the sharp features occur approximately between 3 to 5 and between 11.5 and 13.5 millimeters of distance.

FIGS. 5A, 5B and 6A, 6B are examples where at least two transducers create high pressure wave fronts in physically distinct areas that overlap after some distance. The distance before interaction needs to be long enough to cause significant steepening before the waves combine. This distance will depend on the pressure and frequency of the sound waves and can be as short as a few centimeters. If fired near perpendicular to the surface of the fluid and angled so that they are substantially parallel when they combine, it is possible to create a pressure feature traveling across the surface of the fluid at the desired capillary wavelength which will improve coupling.

To further improve this method, many wave fronts may be used to create by separate systems to build a shock wave train with the correct wavelength spacing to maximally couple to capillary waves. In another arrangement, one or more phased arrays could be used. In this arrangement, half of the array could function as one transducer and the other half could be the other. If using one or more phased arrays it is possible to further shape the acoustic field in order to make higher-pressure regions and translate those regions to desired locations.

Differences in speed of sound may be overcome by setting up a standing wave condition. In this arrangement, a series of shock fronts are created propagating one direction (say positive x-direction) and another wave-train is fired from another set of arrays in the opposite direction (−x in this example). As they pass through each other, the resulting pressure field will have features which can be the correct length-scale. This will increase coupling to the desired capillary wave mode. The "standing wave" is not a true repeating sine wave in the traditional sense but merely a pressure profile that repeats itself at the frequency of the ultrasound.

The high-pressure and/or sharp features may be moved around by changing the phasing between the ultrasonic transducers. Sound waves transmitted from one transducer will reach the opposing transducer and reflect back into the drying environment. In one arrangement, this may be used to add to the transmitted ultrasound from that transducer. If the sharp sound features are to be translated in this arrangement, the transducers will need to translate in space slightly as well as in phase. In another arrangement the transducers may be angled (or phased) slightly so that their beams do not intersect with the opposite transducer.

In another arrangement each transducer may a phased array. The phased arrays allow arbitrary fields to be created and, in this case, may create intersecting focus spots. Just like the parallel transducers, the interacting focus spots will contain sharp features due to wave steepening. The phased arrays may translate this focus point as well as manipulate the phase of each array allowing for arbitrary sharp feature translation to dry the entire hand efficiently. In this arrangement, reflected fields will be unimportant since they will scatter instead of focusing. Monochromatic sound, while typically the easiest to create, is not a requirement.

In another arrangement, broadband acoustic fields may be used. With sufficient bandwidth, arbitrarily-shaped acoustic pressure fields may be created at sharp moments in time. To optimally couple to capillary waves, a repetitive acoustic pattern may be projected onto the hand with the correct wavelength/shape for the desired capillary mode. After the first pulse hits, the pressure field would disperse so as to drive the capillary mode and a repetitive series of pulses at the desired frequency would need to be made. These may be identically shaped or evolve in time with the desired capillary mode.

As the water from the hand is removed, the wetted film becomes thinner and equation 1 no longer applies. The propagation speed begins to change as $h^3$ and the above methods will need to compensate. Thickness change from evaporation may be modeled, and in one arrangement the system may start with a maximum possible assumed thickness and then progress towards thinner films. Given it started at a maximum, at some point the system will encounter the actual film thickness and then enhancement will take place and it will progress towards the (dry) endpoint. Alternatively, the system may measure the average wetting thickness as the user starts the dryer (such as a laser interference method) and the system will start at that value.

In another arrangement, since thickness will influence optimal coupling, monitoring the thickness may be done by looking at the return acoustic power. As the film drifts out of optimal coupling, more sound will be reflected and the system may adjust to compensate until a chosen end-point is reached. In yet another arrangement, the film thickness may be continually monitored using a light-based technique and this information is passed to the ultrasonic system. This may be used as feedback to hold the system in optimal coupling.

Liquid manipulation needs focused fields but not necessarily a phased array (although that makes it much easier). The non-phased-array version would need the entire transducer network to translate the liquid where its field is being projected.

II. Additional Disclosure

The following numbered clauses show further illustrative examples only:

1. A method of liquid manipulation comprising the steps of Providing a plurality of ultrasonic transducers having known relative positions and orientations;

Defining a plurality of control fields wherein each of the plurality of control fields have a known spatial relationship relative to the transducer array;

Defining a control surface onto which the control fields will be projected; and

Orienting the control fields onto the surface so that liquid on that surface is adjusted.

2. A method as in claim 1 where the adjustment is position.

3. A method as in claim 1 where the adjustment is thickness.

4. A method as in claim 1 where the adjustment is flow/particle velocity.

5. A method as in claim 1 where the control fields are dynamically updated as the liquid is adjusted.

6. A method as in claim 1 where the field induces cavitation in the liquid.

7. A method as in claim 1 where the transducer's positions are adjusted to adjust the liquid.

8. A method of de-wetting of an object/person comprising the steps of:

Producing an acoustic field directed at a wetted object/person;

Setting the amplitude or phasing or shape of the acoustic field to de-wet the object/person.

9. A method as in claim 8 where the acoustic field is within a resonant chamber.

10. A method as in claim 8 where the object/person is also subjected to forced air.

11. A method as in claim 8 where the liquid on the wetted object/person experiences improved mass-transfer.

12. A method as in claim 8 where the liquid experiences drop pinch-off from capillary waves.

13. A method as in claim 8 where the acoustic field takes the form of a rotating spiral.

14. A method as in claim 8 where the acoustic field can be adjusted by adjusting the position or phase of one or more transducers.

15. A method as in claim 14 where the transducer(s) create focus regions.

16. A method as in claim 15 where those focus regions are translated across the object/person.

17. A method as in claim 16 where the focus regions push water off the object/person.

18. A method as in claim 16 where the focus regions push water off hands or fingers.

19. A method as in claim 15 where the focus regions move at a speed which improves coupling to capillary waves.

20. A method as in claim 15 where the focus regions occur at a spacing which improves coupling to capillary waves.

21. A method as in claim 15 where translating focus fields are arranged in such a way that converging capillary waves are created.

22. A method as in claim 8 where acoustic fields are arranged so that nonlinear wave steepening creates sharp features.

23. A method as in claim 22 where 2 sources are close to parallel whose sharp features combine after some distance.

24. A method as in claim 22 where 2 sources are close to parallel facing each other whose sharp features combine after some distance.

25. A method as in claim 8 which uses a broadband system to create an acoustic field which has high-pressure features which couples to capillary waves.

26. A method as in claim 8 where the amplitude or phasing changes as wetting thickness changes.

27. A method as in claim 26 which includes a sensor to detect wetting thickness.

28. A method as in claim 26 which includes a sensor to measure reflected ultrasound.

III. CONCLUSION

While the foregoing descriptions disclose specific values, any other specific values may be used to achieve similar results. Further, the various features of the foregoing embodiments may be selected and combined to produce numerous variations of improved haptic systems.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. The term "coupled" as used herein is defined as connected, although not necessarily directly and not necessarily mechanically. A device or structure that is "configured" in a certain way is configured in at least that way but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

We claim:

1. A method of de-wetting a human body part comprising the steps of:

establishing a transducer array having a plurality of ultrasonic transducers having known relative positions and orientations;

using the transducer array to produce an acoustic field directed at a wetted human body part; and setting an acoustic field parameter selected from the group consisting of frequencies, amplitudes, phasings, and shapes to de-wet the wetted human body part.

2. A method as in claim 1, wherein the acoustic field is within a resonant chamber.

3. A method as in claim 1, wherein the human body part is also subjected to forced air.

4. A method as in claim 1, wherein liquid on the human body part experiences improved mass-transfer.

5. A method as in claim 1, wherein liquid on the human body part experiences drop pinch-off from capillary waves.

6. A method as in claim 1, wherein the acoustic field is adjusted by adjusting a position or phase of at least one of the plurality of ultrasonic transducers.

7. A method as in claim 6, wherein at least one of the plurality of ultrasonic transducers create focus regions.

8. A method as in claim 7, wherein the focus regions are translated across the human body part.

9. A method as in claim 8, wherein the focus regions push water off the human body part.

10. A method as in claim 9, wherein the human body part comprises a hand.

11. A method as in claim 7, wherein the focus regions move at a speed that improves coupling to capillary waves.

12. A method as in claim 7, wherein the focus regions occur at a spacing that improves coupling to capillary waves.

13. A method as in claim 7, further comprising:

translating focus fields that create converging capillary waves.

14. A method as in claim 1, wherein the acoustic fields are arranged so that nonlinear wave steepening creates sharp features.

15. A method as in claim 1, wherein a broadband system that creates the acoustic field has high-pressure features coupled to capillary waves.

16. A method as in claim 1, wherein the acoustic field parameter changes as wetting thickness changes.

17. A method as in claim 16, further comprising:

a sensor to detect wetting thickness.

18. A method as in claim 1, wherein the acoustic field takes the form of a rotating spiral.

* * * * *